US012006924B2

(12) United States Patent
Mickiewicz et al.

(10) Patent No.: US 12,006,924 B2
(45) Date of Patent: Jun. 11, 2024

(54) AXIAL PISTON PUMP MOUNTING FLANGE CONFIGURATION

(71) Applicant: Caterpillar Inc., Peoria, IL (US)

(72) Inventors: Matthew G. Mickiewicz, Yorkville, IL (US); Stive Ramalho, Isle d'Abeau (FR); Darren Joseph Hopf, Peoria, IL (US); Justin Douglas Speichinger, Morton, IL (US); Paul Alan Rousseau, Clayton, NC (US); Brice Mallein, Coublevie (FR)

(73) Assignee: Caterpillar Inc., Peoria, IL (US)

( * ) Notice: Subject to any disclaimer, the term of this patent is extended or adjusted under 35 U.S.C. 154(b) by 87 days.

(21) Appl. No.: 17/393,685

(22) Filed: Aug. 4, 2021

(65) Prior Publication Data

US 2023/0043842 A1 Feb. 9, 2023

(51) Int. Cl.

| | |
|---|---|
| ***F04B 1/2064*** | (2020.01) |
| ***F04B 53/22*** | (2006.01) |
| ***F04C 11/00*** | (2006.01) |

(52) U.S. Cl.

CPC ..... *F04B 1/2064* (2013.01); *F04B 53/22* (2013.01); *F04C 11/005* (2013.01); *F04C 2270/03* (2013.01)

(58) Field of Classification Search

CPC ..... F15B 15/08; F04D 25/04
USPC ..... 417/405
See application file for complete search history.

(56) References Cited

U.S. PATENT DOCUMENTS 2,439,241 A 4/1948 Curtis et al.
2,965,040 A * 12/1960 Eisenberg ..... F04C 15/0026 418/152
3,407,742 A * 10/1968 Mitchell ..... F01C 21/0809 418/268
3,817,665 A 6/1974 Myers
4,023,836 A 5/1977 Applehans
4,225,186 A 9/1980 Stratton
4,501,536 A 2/1985 Middlekauff
4,586,885 A * 5/1986 Middlekauff ..... F04C 2/103 418/61.3

(Continued)

FOREIGN PATENT DOCUMENTS

CN 202597963 12/2012
CN 106678011 A 5/2017

(Continued)

OTHER PUBLICATIONS

Texas Flange Product Catalog: Ver 5.00, TexasFlange.com, Jun. 2019, Retrieved from May 23, 2020 capture https://web.archive.org/web/20200523222344/https://www.texasflange.com/wp-content/uploads/2019/06/catalog-c-v5.pdf (Year: 2019).*

(Continued)

*Primary Examiner* — Devon C Kramer
*Assistant Examiner* — Benjamin Doyle
(74) *Attorney, Agent, or Firm* — Schwegman Lundberg & Woessner, P.A.

(57) ABSTRACT

A hydraulic pump or motor includes a mounting flange that is disposed at the first end of the housing. The mounting flange defines a pair of fastener receiving apertures that are disposed along the X-axis on either side of the shaft. The pair of fastener receiving apertures each define a radius center that are spaced away from each other a X dimension, and a pilot projection extends longitudinally away from the mounting flange, defining a pilot projection diameter. A ratio of the X dimension to the pilot projection diameter ranges from 1.07 to 1.11.

20 Claims, 5 Drawing Sheets

(56) References Cited

U.S. PATENT DOCUMENTS

| | | | | |
|---|---|---|---|---|
| 4,601,378 | A | 7/1986 | Pierce et al. | |
| 5,423,183 | A * | 6/1995 | Folsom | F16H 39/32 60/413 |
| 5,645,343 | A | 7/1997 | Rinehimer | |
| 5,645,363 | A | 7/1997 | Dafforn et al. | |
| 6,345,968 | B1 | 2/2002 | Shupe | |
| 6,398,521 | B1 * | 6/2002 | Yorulmazoglu | F04D 29/044 417/423.6 |
| 6,406,271 | B1 * | 6/2002 | Valentin | F04B 1/126 91/499 |
| 6,481,388 | B1 | 11/2002 | Yamamoto | |
| 6,688,858 | B1 | 2/2004 | Boone et al. | |
| 6,742,816 | B2 | 6/2004 | Rocheleau | |
| 6,896,491 | B2 | 5/2005 | Trubnikov et al. | |
| 7,635,255 | B2 | 12/2009 | Gleasman et al. | |
| 7,695,252 | B2 | 4/2010 | Sakikawa | |
| 10,145,396 | B2 | 12/2018 | Du et al. | |
| 11,168,772 | B2 * | 11/2021 | Mathers | F16H 39/04 |
| 11,255,193 | B2 * | 2/2022 | Mathers | F01C 21/0881 |
| 2004/0226617 | A1 | 11/2004 | Arentsen et al. | |
| 2009/0056123 | A1 | 3/2009 | Phillips et al. | |
| 2009/0280021 | A1 * | 11/2009 | Mathers | F01C 21/0863 418/184 |
| 2012/0275928 | A1 | 11/2012 | Fritz et al. | |
| 2016/0039277 | A1 * | 2/2016 | Falls | H02K 7/006 310/58 |
| 2016/0084321 | A1 | 3/2016 | Mihajlovic et al. | |
| 2017/0191499 | A1 | 7/2017 | Chrabascz et al. | |
| 2018/0162382 | A1 * | 6/2018 | Colavincenzo | B60W 10/30 |
| 2020/0070644 | A1 * | 3/2020 | Tigue | B62D 55/06 |
| 2021/0388825 | A1 * | 12/2021 | Watt | B60K 1/00 |

FOREIGN PATENT DOCUMENTS

| | | |
|---|---|---|
| CN | 107859635 | 3/2018 |
| CN | 104295479 | 7/2018 |
| CN | 211853102 | 11/2020 |
| CN | 213018226 | 4/2021 |
| EP | 2059674 | 8/2018 |
| EP | 3539876 | 9/2019 |
| GB | 673718 A | 6/1952 |
| GB | 2101220 | 1/1983 |
| GB | 2506148 | 12/2019 |
| TW | M559939 | 5/2018 |
| WO | 2015074440 A1 | 5/2015 |

OTHER PUBLICATIONS

Flange Faces, saVRee 3D Interactive Media, Nov. 25, 2020, https://web.archive.org/web/20201125173751/https://savree.com/en/encyclopedia/flange-faces.*

Written Opinion and International Search Report for Int'l. Patent Appln. No. PCT/US2022/038260, dated Oct. 28, 2022 (13 pgs).

Rexroth Bosch Group, "Axial Piston Variable Pump", The Drive Control Company, RE 92050 Oct. 2018, 76 pages.

SKF, "UCF 212-36 Square Flanged Ball Bearing Units", www.skf.com, May 7, 2021, 4 pages.

"U.S. Appl. No. 17/171,473, Non Final Office Action mailed Apr. 13, 2023", 23 pgs.

"U.S. Appl. No. 17/171,473, Response filed Jul. 12, 2023 to Non Final Office Action mailed Apr. 13, 2023", 16 pgs.

"U.S. Appl. No. 17/171,473, Final Office Action mailed Oct. 3, 2023", 23 pgs.

"International Application Serial No. PCT US2022 015187, International Search Report and Written Opinion mailed May 3, 2022", 8 pgs.

"International Application Serial No. PCT US2022 015165, International Search Report and Written Opinion mailed May 31, 2022", 11 pgs.

Casappa Polaris, "Hydraulic Gear Pumps and Motors", (May 4, 2023), 92 pgs.

* cited by examiner

AXIAL PISTON PUMP MOUNTING FLANGE CONFIGURATION

TECHNICAL FIELD

The present disclosure relates to hydraulic pumps or motors that are used to power lifting cylinders and the like. Specifically, the present disclosure relates to a mounting configuration for such pumps or motors that allows a shaft of the pump or motor to accommodate increased torque.

BACKGROUND

Engine assemblies often employ hydraulic pumps or motors that provide hydraulic oil at high pressures, or convert hydraulic oil at high pressures or high flow rates to high torque supplied by the shaft. Some hydraulic pumps or motors are coupled to one or more lifting cylinders on a mine hauling truck or the like for lifting and lowering its bed. Adhesion of material such as oil sand ore may lead to sticking of these lifting cylinders. This may lead to increased stress on the lifting cylinders and lead to counterbalance valve instability. Using a bigger or more powerful pump may help alleviate these problems.

However, there may be limited space in the hydraulic system, and/or it may be more costly to employ a larger hydraulic motor and/or pump, making the use of such a motor and/or pump impractical. Also, it may be desirable to retrofit hydraulic systems already in the field with a more robust pump without changing the design of the machine or the hydraulic system significantly.

As can be seen, there currently exists a tradeoff between improved or consistent lifting capacity of such hydraulic systems and their associated lifting cylinders, and the cost and/or size of the hydraulic pump.

SUMMARY

A hydraulic pump or motor with a mounting configuration for increased torque according to an embodiment of the present disclosure is provided. The pump or motor may comprise a shaft defining a longitudinal axis, a Y-axis extending upwardly and orthogonally from the longitudinal axis, and an X-axis extending orthogonally to the longitudinal axis, and the Y-axis. A housing may define a first longitudinal end, a second longitudinal end, and a cavity that extends from adjacent the first longitudinal end toward the second longitudinal end. A plurality of mechanical components including one hydraulic interacting component may be disposed in the cavity, and an inlet and an outlet that are in fluid communication with the cavity, the inlet and the outlet being disposed at the second longitudinal end. The shaft may extend from the cavity past the first longitudinal end of the housing, and a mounting flange may be disposed at the first longitudinal end of the housing. The mounting flange may define a pair of fastener receiving apertures that are disposed along the X-axis on either side of the shaft, and the pair of fastener receiving apertures may each define a radius center that are spaced away from each other a X dimension. A pilot projection may extend longitudinally away from the mounting flange, defining a pilot projection diameter, and a ratio of the X dimension to the pilot projection diameter may range from 1.07 to 1.11. Or, a pilot recess may extend longitudinally into the mounting flange, defining a pilot recess diameter, and a ratio of the X dimension to the pilot recess diameter may range from 1.07 to 1.11.

A hydraulic pump or motor with a mounting configuration for increased torque according to another embodiment of the present disclosure is provided. The pump or motor may comprise a shaft defining a longitudinal axis, a Y-axis extending upwardly and orthogonally from the longitudinal axis, and an X-axis extending orthogonally to the longitudinal axis, and the Y-axis. A housing may define a first longitudinal end, a second longitudinal end, and a cavity that extends from adjacent the first longitudinal end to the second longitudinal end. A plurality of mechanical components including one hydraulic interacting components may be disposed in the cavity, and an inlet and an outlet that are disposed near the second longitudinal end and that are in communication with the cavity. The shaft may extend from the cavity past the first longitudinal end of the housing, and a mounting flange may be disposed at the first longitudinal end of the housing. The mounting flange may define a pair of bolt receiving slots that are disposed along the X-axis on either side of the shaft, the pair of bolt receiving slots may each define a radius center that are spaced away from each other a X dimension, and at least one of the bolt receiving slots defines a slot width of the slot. A ratio of the X-dimension to the slot width may range from 7.00 to 10.2.

A hydraulic motor pump assembly according to an embodiment of the present disclosure may comprise a shaft defining a longitudinal axis, a Y-axis extending upwardly and orthogonally from the longitudinal axis, and an X-axis extending orthogonally to the longitudinal axis, and the Y-axis. A housing may define a first longitudinal end, a second longitudinal end, and a cavity that extends from adjacent the first longitudinal end toward the second longitudinal end. A plurality of mechanical components including at least one hydraulic interacting component may be disposed in the cavity. An inlet and an outlet may be disposed near the second longitudinal end, which are in communication with cavity. The shaft may extend from the cavity past the first longitudinal end of the housing, and a mounting flange may be disposed at the first longitudinal end of the housing. The mounting flange may define a pair of fastener receiving apertures that are disposed along the X-axis on either side of the shaft, the pair of fastener receiving apertures may each define a radius center that are spaced away from each other a X dimension. A pilot projection may extend longitudinally away from the mounting flange, defining a pilot projection diameter, and a ratio of the X dimension to the pilot projection diameter may ranges from 1.07 to 1.11. Or, a pilot recess may extend longitudinally into the mounting flange, defining a pilot recess diameter, and a ratio of the X dimension to the pilot recess diameter may range from 1.07 to 1.11.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
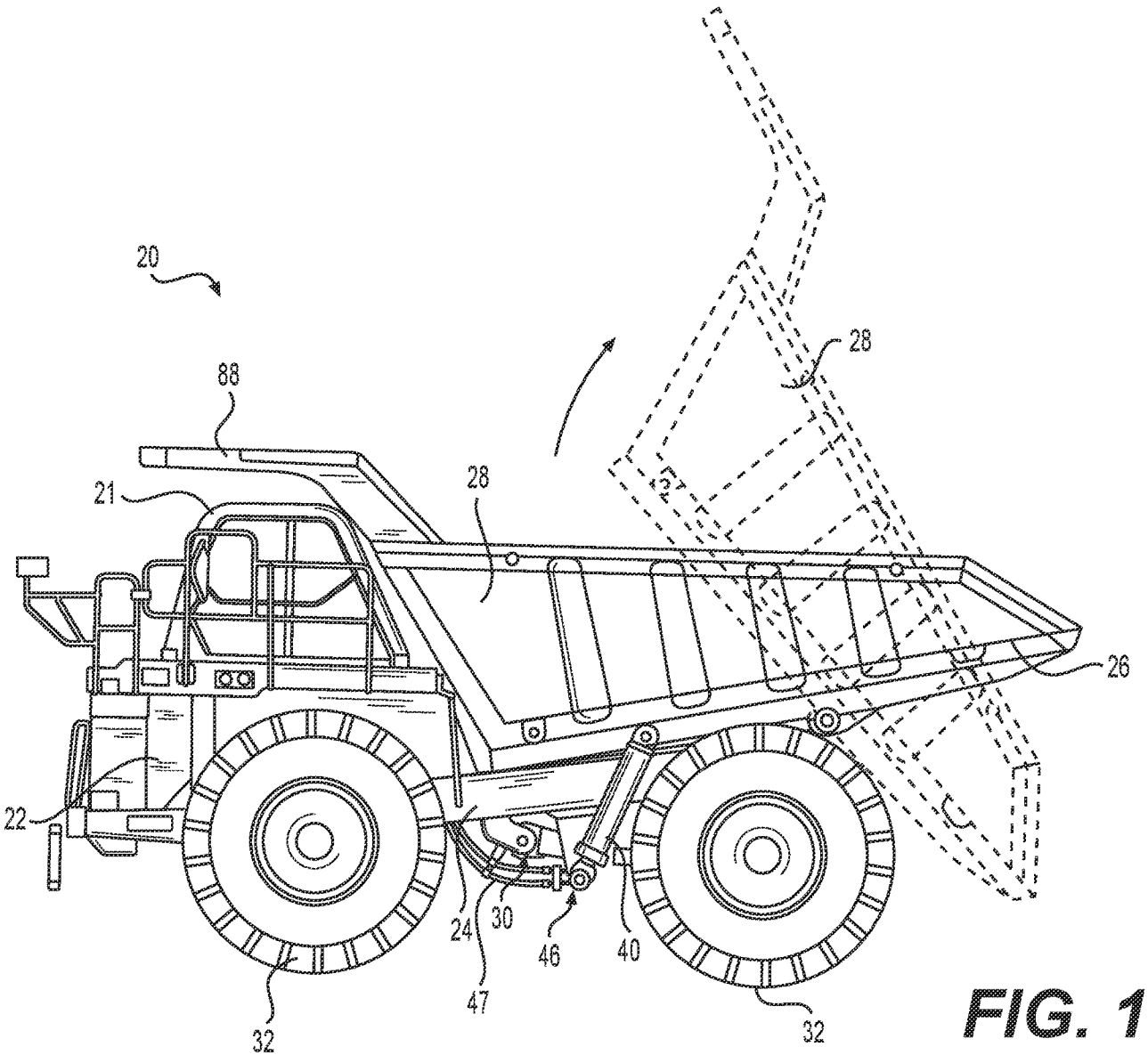
FIG. 1 is a perspective view of a mine hauling truck that may have a hydraulic bed lift system that may use a hydraulic valve and control circuit to control the truck bed lift cylinders to raise or lower the truck bed. The hydraulic bed lift system may employ a hydraulic axial piston pump having a mounting configuration according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of hydraulic pump or motor assembly, a mounting flange configuration, and a hydraulic system that are constructed according to various embodiments of the present disclosure will be discussed that may break the aforementioned compromise between the size/cost of a pump or motor and the output/input of the torque to increase the lifting capacity of the lifting cylinders for raising the bed of mining haul truck or the like will be discussed momentarily. Now, an exemplary machine that may employ the embodiments such as a mining haul track will be discussed first with the understanding that any suitable machine including an electromotive diesel engine, a bulldozer, or other heavy equipment used in the marine, earth moving, construction, and mining industries may use these embodiments.

Figure 2:
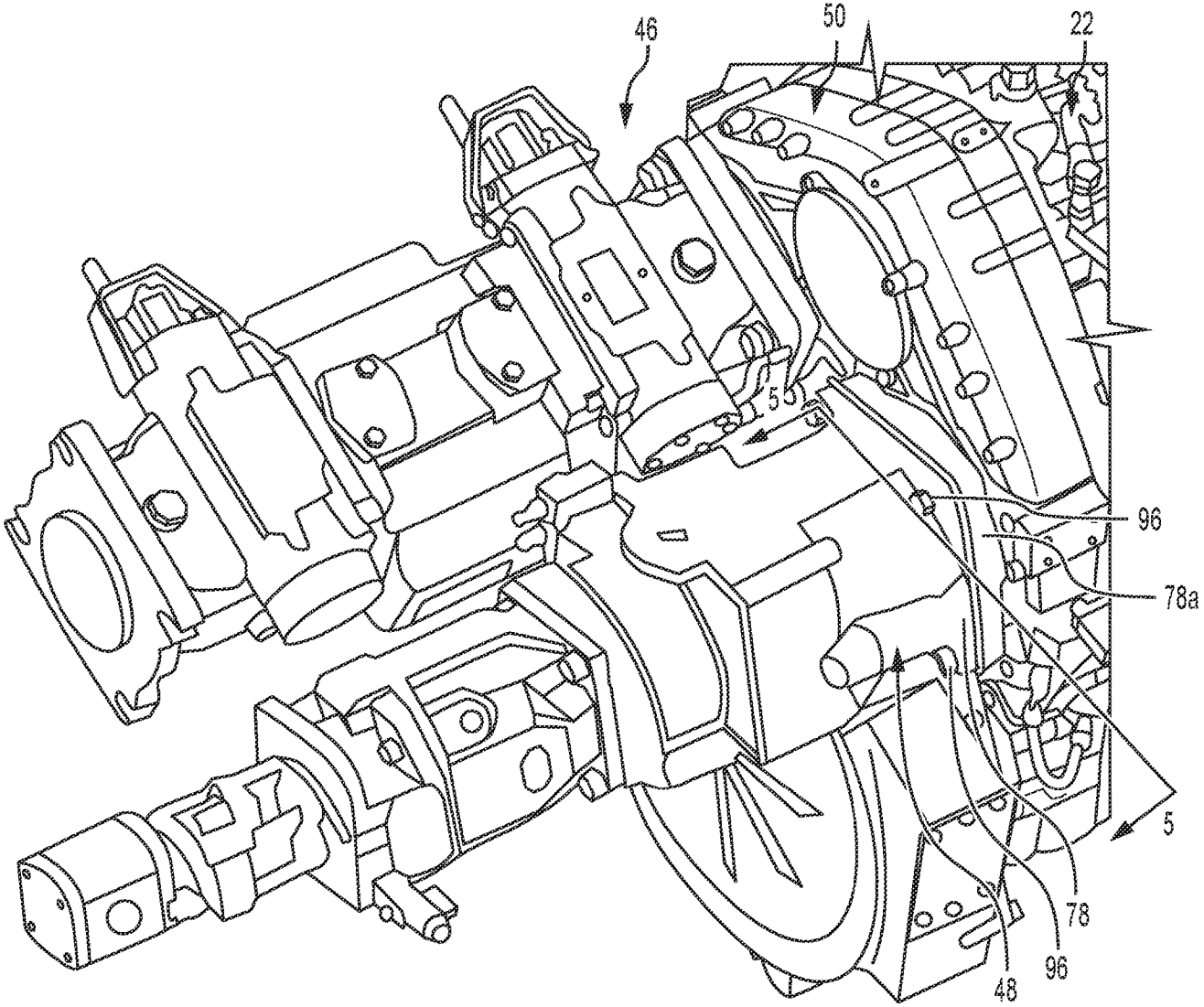
FIG. 2 is a perspective view of the hydraulic bed lift system of the mine hauling truck of FIG. 1, depicting the hydraulic axial piston pump attached to a mounting flange having a configuration according to an embodiment of the present disclosure.

Looking at FIGS. 1 and 2, a machine 20 in the form of a rigid frame dump truck includes a truck bed lifting hydraulic system 46.

In FIG. 1, the machine 20 may include a cab 21, an engine 22, a frame 24, and a truck bed 26, which is part of a payload bucket 28 that may hold material such as dirt, rocks, etc. The bucket and bed may be pivotally connected to the rear of the frame 24. A suspension system 30 is also provided to absorb shock from the ground engaging elements 32 (e.g., may be tires as shown, or tracks, etc.).

It is to be understood that other types of machines that use hydraulic systems such as hydraulic lifting systems including articulated trucks, excavators, cars, wheel loaders, etc. may use the embodiments of the present disclosure. Hence, this machine is provided as a non-limiting example.

The engine 22 is configured to supply power to the machine, such as but not limited to, a diesel engine, a gasoline internal combustion engine, a natural gas engine, an electric motor, a battery pack and other known power generating sources or combinations thereof.

With continued reference to FIGS. 1 and 2, the details of the engine 22 and the truck bed lifting hydraulic system 46 may be more clearly seen. The system 46 includes a hydraulic pump 48 that supplies pressurized hydraulic fluid/oil (via hydraulic line(s) 47) to the actuation or lifting cylinders 40 that raise and lower the truck bed. As will be discussed momentarily, the shaft of the pump is powered by the engine, providing the necessary fluid flow and pressure. The mounting flange configuration (e.g., see 78 and 78*a* in FIG. 2) may allow increased torque to be provided to the pump by the engine, which in turn may increase fluid flow and pressure, allowing the movement of the cylinders even when covered in mud, dirt, oil sand ore, etc. in the field.

Figure 3:
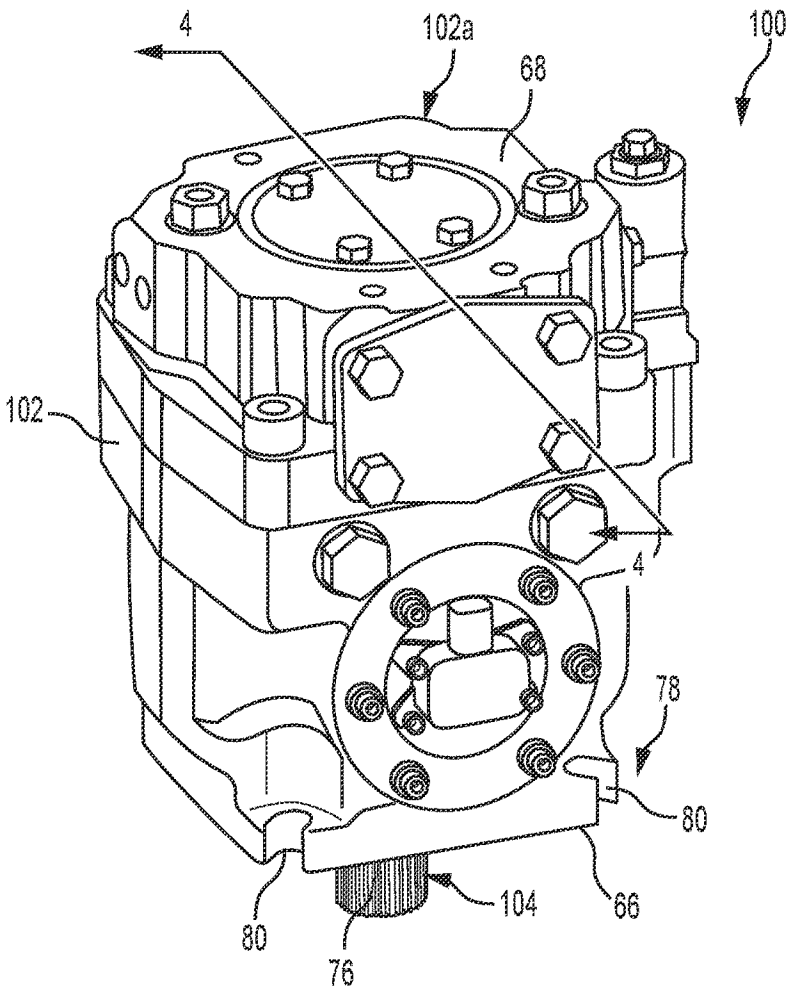
FIG. 3 is a perspective view of the hydraulic axial piston pump of FIG. 2, shown in isolation.
Figure 4:
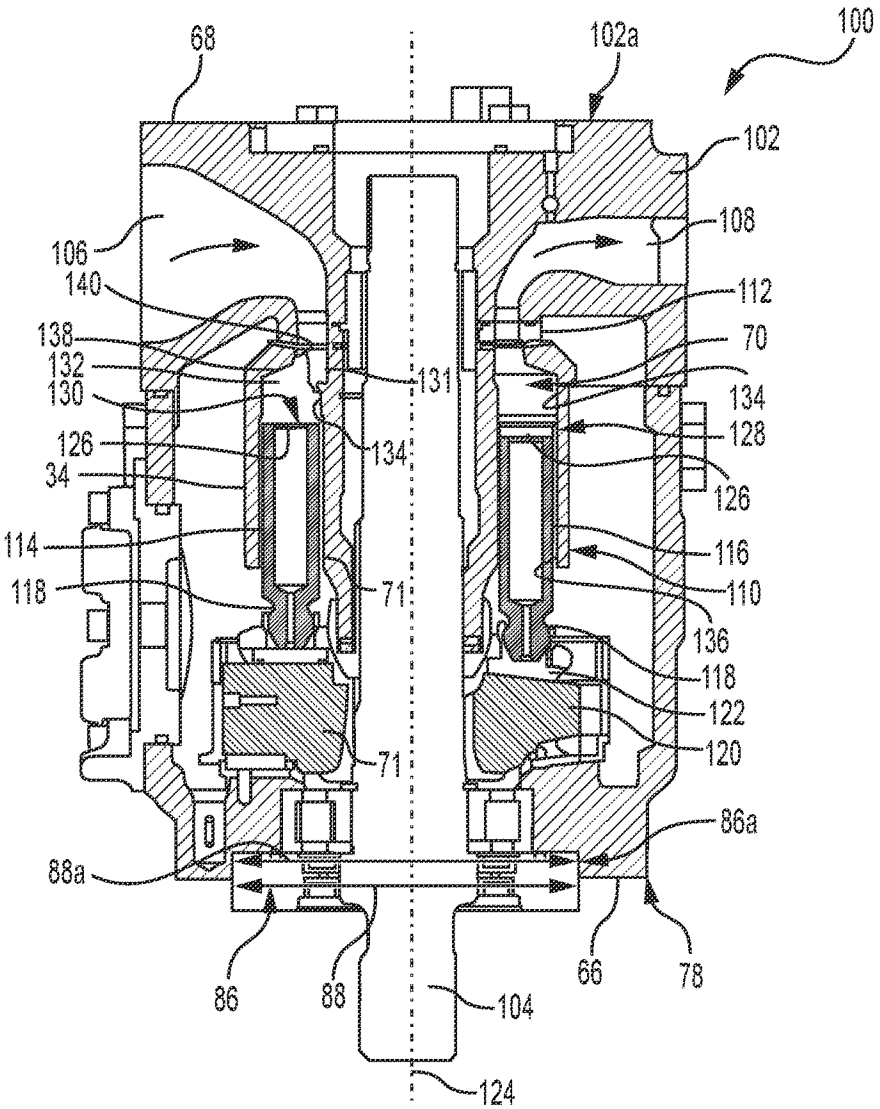
FIG. 4 is a side sectional view of the hydraulic axial piston pump of FIG. 3 taken along lines 4-4 thereof, revealing the inner components of the pump.

Referring now to FIGS. 3 and 4, an axial piston pump 100 (that may be used as hydraulic pump 48 in FIG. 2) will now be discussed. The pump 100 may include an exterior housing 102 from which extends a drive shaft 104 for connection to a transmission, torque converter, or pump drive 50 and engine 22 (see FIG. 2) of a larger machine (e.g., truck 20 in FIG. 1) on which the pump is positioned. The pump 100 is designed to draw hydraulic fluid in through inlet 106 (see FIG. 4) and expel hydraulic fluid out through outlet 108 for communication to implements, work arms, and/or cylinders 40 of the machine.

Focusing on FIG. 4, a cross-sectional view of the pump 100, taken along lines 4-4 of FIG. 3 is shown. It can be seen that the drive shaft 104 is operatively connected to a barrel 110 adapted to rotate within the housing 102. The barrel 110 is positioned next to a valve plate 112 which itself is in fluid communication with the aforementioned inlet 106 and outlet 108. A piston 114 is mounted to reciprocate within each of the cylinders 116. More specifically, each piston 114 is adapted to reciprocate within the cylinders 116 as the pistons 114 and cylinder barrel 110 rotate around the pump 100 through inlet and outlet strokes.

In order to reciprocate the pistons 114 through the cylinders 116, a driven end 118 of each piston is rotatably and slidably engaged with a swashplate 120 by way of a shoe 122. As will be noted, the swashplate 120 can be provided at a transverse angle relative to the cylinder barrel 110 such as that as the barrel 110 and pistons 114 rotate about longitudinal axis 124 under the influence of hydraulic fluid entering and exiting the cylinders 116 or as the drive shaft 104 is driven, the pistons 114 are caused to reciprocate back and forth therein, moving the fluid.

Moreover, the angle at which the swashplate 120 is positioned necessarily dictates the resulting volume of fluid flow from the pump 100. For example, if the swashplate 120 is parallel to the valve plate 112, then there would be no flow of fluid at all. However, with each degree the swashplate 120 is pivoted away from parallel, the resulting flow of the expelled fluid is increased.

Opposite to the driven end 118, each piston 114 includes a working end 126. Also shown in FIG. 4, the working end 126 is adapted to reciprocate between a bottom dead center position 128, and a top dead center position 130.

As one of the ordinary skill in the art will understand, during the filling or intake stroke of each piston 114, the working end 126 moves from the top dead center position 130 to the bottom dead center position 128, and during the exhaust stroke, the working end 126 moves from a bottom dead center position 128 to the top dead center position 130. The hydraulic fluid drawn in during the intake stroke and expelled during the exhaust stroke is navigated through a plurality of fluid flow apertures 131.

With continued reference to FIG. 4, each of the fluid flow apertures 131 may include a plurality of surfaces angled at specific dimensions and degrees so as to most effectively fill and exhaust the hydraulic fluid. For example, each cylinder 116 may terminate in an antechamber 132 having an antechamber wall 134 concentric with the cylinder wall 136, but with a slightly smaller diameter. The antechamber wall 134 leads to a first output engagement wall 138 provided at a transverse angle relative to the antechamber wall 134. The first output engagement wall 138 then extends into a second output engagement wall 140 provided at an angle relative to the first output engagement wall 138.

In some embodiments, the first and second output engagement walls 138 and 140, respectively, are not planar in shape, but rather curved in accordance with the overall kidney shape (specifically a compound kidney shape) of the fluid flow apertures 131.

It's to be understood that the inner workings of the pump may vary from this detailed description and includes other embodiments of rotational impeller type pumps, as well as other types of axial displacement pumps, gear pumps, etc.

Figure 5:
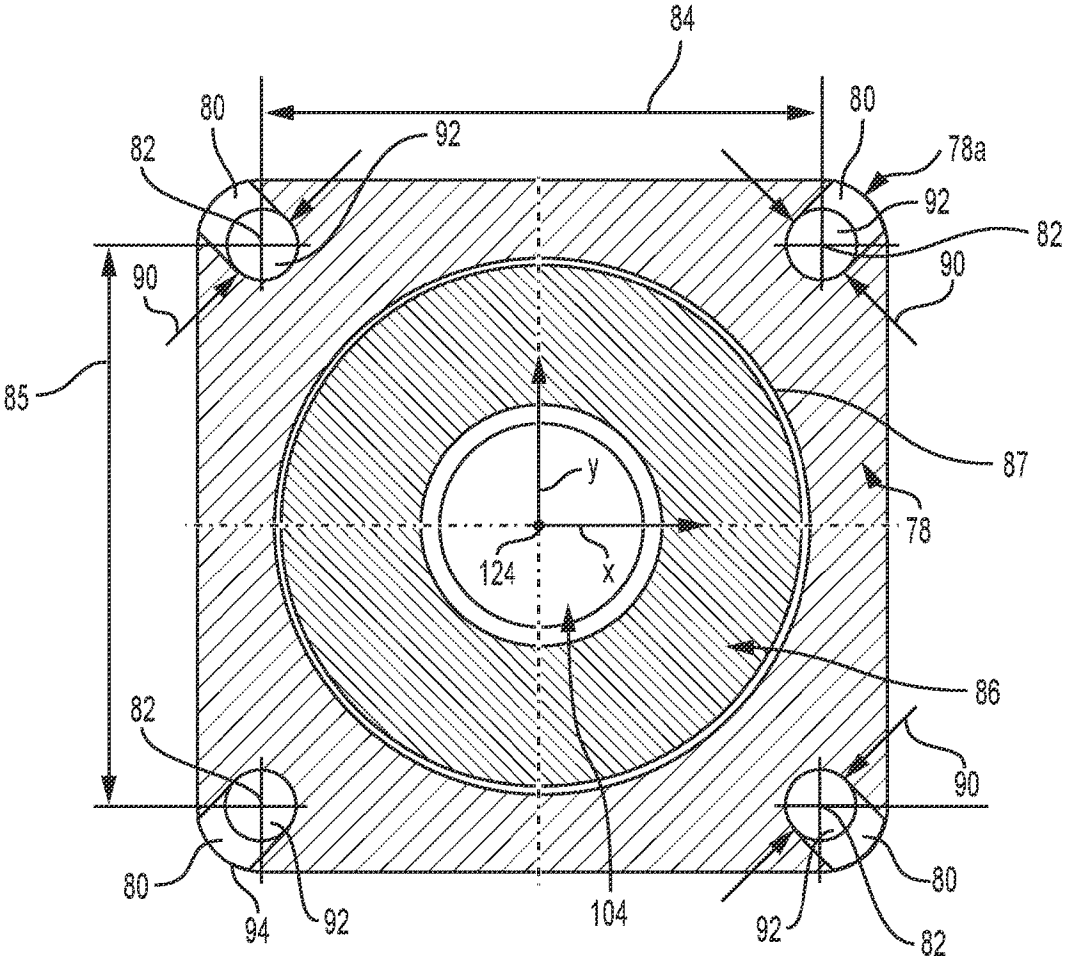
FIG. 5 is a front sectional view of a mounting flange that is configured according to an embodiment of the present disclosure to mate with the matching mounting flange of the pump of FIG. 4. This view taken along lines 5-5 of FIG. 2.

Referring now to FIGS. 3 thru 5, a pump 100 with mounting flange configured according to an embodiment of the present disclosure will be discussed in further detail. The pump 100 including a shaft 104, and a housing 102. The shaft 104 may include a body of revolution (e.g., cylindrical, conical, etc.) defining a longitudinal axis 124 (see FIG. 4), a Y-axis extending upwardly and orthogonally from the longitudinal axis 124 (see FIG. 5), and an X-axis extending orthogonally to the longitudinal axis 124, and the Y-axis.

As shown in FIGS. 3 and 4, the housing 102 may define a first longitudinal end 66, a second longitudinal end 68, and a cavity 70 that extends from the first longitudinal end 66 to the second longitudinal end 68. That is to say, the cavity 70 may have a portion that extends completely through the body of the housing 102 or only from adjacent one longitudinal end toward another longitudinal end. A plurality of mechanical components (see 71) including at least one hydraulically driven/driving component may be disposed in the cavity of the housing 102. Examples of these components may include at least one of the following: a vane, a gear, an impeller, a piston 114, and a swash plate 120, etc.

The manifold cap 102*a* may be attached (e.g., via fasteners) to the second longitudinal end 68, and may define an inlet 106 and an outlet 108 (see FIG. 4). The shaft 104 may extend from the cavity 70 of the housing 102, and past the first longitudinal end 66 of the housing 102.

In operation for a motor, the hydraulic fluid/oil enters the inlet and drives the internal components of the motor, and then exits the outlet. The internal components of the motor are mechanically coupled to the shaft, which then rotates. The end of the shaft interfaces with the hub of a device to drive the device. This reverse is true for the operation of a pump. The shaft of the pump may be powered by the engine, which in turn rotates the internal components of the pump creating hydraulic pressure and flow. One example of part of such an interface between the engine, transmission, torque converter, or pump drive and the pump is shown in FIG. 3 as an exposed free end of the shaft 104 that includes teeth 76. Other types of interfaces are possible in other embodiments of the present disclosure including splines, press fits, fastening, etc.

Focusing now on FIG. 5, a mounting flange 78 may be disposed at the first longitudinal end 66 of the housing, defining a pair of bolt receiving slots 80 that are disposed along the X-axis on either side of the shaft 104. The pair of bolt receiving slots 80 may each define a radius center 82 that are spaced away from each other an X dimension 84 (i.e., the dimension is measured along the X-axis), and a pilot projection 86 that extends longitudinally away from the mounting flange 78, for inserting into the pilot cavity 87 of the mounting flange 78*a* of the engine, transmission, torque converter or pump drive, etc. A similar Y dimension may be present (and may have the same value).

Looking at FIGS. 4 and 5, simultaneously, it may be understood that the projection may be part of mounting flange 78*a* of the engine, transmission, torque converter or pump drive, while the mounting flange 78 of the pump may have a pilot recess 86*a* (see FIG. 4) for receiving the projection. Or, the projection may be separate from both flanges, being inserted into the cavities of both flanges during alignment and assembly.

Looking at FIG. 4, the pilot projection 86 may define a pilot projection diameter 88, and a ratio of the X dimension 84 to the pilot projection diameter 88 may range from 1.07 to 1.11 in some embodiments of the present disclosure. Alternatively, if a pilot recess 86*a* is provided, then a ratio of the X dimension 84 to the pilot recess diameter 88*a* may range from 1.07 to 1.11 in some embodiments of the present disclosure;

In such a case as seen in FIG. 5, each of the pair of bolt receiving slots defines a slot width 90, and a ratio of the X dimension 84 to the slot width 90 may range from 7.00 to 10.2 for some embodiments of the present disclosure.

The hydraulic motor may have a capacity of 50/450 cc/rev, when the X dimension 84 ranges from 148.0 mm to 152.0 mm (e.g., 150.0 mm), the slot width 90 ranges from 15.0 mm to 21.0 mm, and the pilot projection diameter 88 ranges from 138.0 mm to 142.0 mm (e.g., 140.0 mm) when a pilot projection is used. If a pilot recess is employed, its diameter may be slightly larger by up to 1.0 mm. Other capacities and dimensions are possible in other embodiments of the present disclosure. When such dimensions and capacities are present, the shaft 58 may transmit more than 1700 n/m (newton meters) of torque.

As shown in FIG. 4, the pilot projection 86 may be a separate component from the rest of the housing, but not necessarily so. The pilot projection may be integral with the mounting flange. When separate, the pilot projection may be fastened to the mounting flange of either the pump or other mating device, welded to either mounting flange, etc.

To help withstand the increased torque, one or more bolts 96 such as a M14, M16, or M20 bolt, (see FIG. 2) may each pass longitudinally through each of the pair bolt receiving slots 80 for attaching the pump to the transmission, torque converter, pump drive or engine.

The housing, mounting flange and manifold cap may be cast or molded from any suitable material including, but not limited to, steel, aluminum, iron, and thermoplastics.

Any of the dimensions, configurations, materials, etc. discussed herein may be varied as needed or desired to be different than any value or characteristic specifically mentioned herein or shown in the drawings for any of the embodiments.

INDUSTRIAL APPLICABILITY

In practice, an engine assembly, a hydraulic system, a female mounting flange or a male mounting flange, and/or a hydraulic pump assembly constructed according any embodiment disclosed herein may be sold, bought, manufactured or otherwise obtained in an OEM (original equipment manufacturer) or after-market context. In some cases, various components, of the engine assembly, a hydraulic system, and the hydraulic pump assembly, etc. may be provided as a kit to repair or retrofit a machine in the field.

Moreover, embodiments of a hydraulic pump or hydraulic motor that may fit into existing engines and/or machines, unexpectedly breaking the size/cost versus torque compromise discussed earlier herein will now be discussed in detail with reference to FIGS. 3 thru 5.

It is to be understood that components of a motor may also be used as a pump by reversing the flow of hydraulic fluid and pressuring the fluid by supplying torque to the shaft, instead of receiving torque from the shaft.

Such a hydraulic pump or hydraulic motor according to an embodiment of the present disclosure (e.g., pump 100) may include a shaft 104, a housing 102, and a manifold cap 102*a* as previously described herein.

A plurality of mechanical components 71 including one hydraulic interacting component that are disposed in the housing (e.g., a piston 114, a vane, a gear, an impeller, a swashplate 120, a shoe 122, etc.).

The mounting flange 78 may define a pair of bolt receiving slots 80 that are disposed along the X-axis on either side of the shaft, the pair of bolt receiving slots 80 may each define a radius center 82 that are spaced away from each other a X dimension 84. A pilot projection 86 may extend longitudinally away from the mounting flange 78, defining a pilot projection diameter 88, and a ratio of the X dimension 84 to the pilot projection diameter 88 may range from 1.07 to 1.11 in some embodiments of the present disclosure.

Also, a ratio of the X dimension 84 to the slot width 90 may range from 7.00 to 10.2 in some embodiments of the present disclosure. The hydraulic pump or motor has a capacity of 50/450 cc/rev, the X dimension 84 may range from 148.0 mm to 152.0 mm (e.g., 150.0 mm), the slot width 90 may range from 15.0 mm to 21.0 mm, and the pilot projection diameter 88 may range from 138.0 mm to 142.0 mm (e.g., 140.0 mm).

As a result of this configuration, the shaft 104 may be able to receive or deliver more than 1700 n/m of torque.

Such a hydraulic pump or hydraulic motor according to yet another embodiment of the present disclosure may be characterized in that a ratio of the X-dimension 84 to the slot width 90 may range from 7.10 to 10.2, while a ratio of the pilot projection diameter 88 to the slot width 90 may range from 6.50 to 9.50.

In such an embodiment, the hydraulic pump or motor may have a capacity of 50/450 cc/rev, the X dimension may range from 148.0 mm to 152.0 mm, the slot width 90 may range from 15.0 mm to 21.0 mm, and the pilot projection diameter may range from 138.0 mm to 142.0 mm as already described herein.

This embodiment too may have a shaft 104 that is capable of receiving or delivering more than 1700 n/m of torque.

In more general terms, the mounting configuration according to various embodiments of the present disclosure may be described as follows focusing on FIGS. 2, 4 and 5 with the understanding that one or more features on one flange may be swapped with those of another flange.

A first flange 78 may include either a pilot projection 86 or a pilot recess 86*a*, and at least two fastener receiving apertures (e.g., bolt receiving slots clearance holes, thru-holes or threaded holes) that each define a radius center 82 that are spaced away from each other a predetermined dimension (e.g., the X dimension 84).

The pilot projection 86 or the pilot recess 86*a* defines either a pilot projection diameter 88 (see FIG. 5) or a pilot recess diameter 88*a*. A ratio of the predetermined dimension to the pilot projection diameter may range from 1.07 to 1.11, or a ratio of the predetermined dimension to the pilot recess diameter may range from 1.07 to 1.11 in some embodiments of the present disclosure as alluded to earlier herein.

In some embodiments, the flange 78 includes a pilot projection 86 defining the pilot projection diameter 88, and the at least two fastener receiving apertures are slots 80 that define a slot width 90, and extend through a perimeter 94 of the flange 78 (but not necessarily so). A ratio of the predetermined dimension (e.g., the X dimension 84) to the slot width 90 may range from 7.00 to 10.2, and a ratio of the pilot projection diameter 88 to the slot width 90 may range from 6.50 to 9.50.

In certain embodiments, the flange 78, 78*a* may include a pilot recess 88*a*, and the at least two fastener receiving apertures are threaded holes 92. In specific embodiments, the threaded holes 92 are configured to mate with M14, M16, or M20 bolts.

Any of the aforementioned features may be differently configured or have different ranges of ratios and dimensions than what has been described. The female mounting member may be made from any suitable material as previously described herein with respect to the housing, etc.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A hydraulic pump or motor comprising:

a shaft defining a longitudinal axis, a Y-axis extending upwardly and orthogonally from the longitudinal axis, and an X-axis extending orthogonally to the longitudinal axis, and the Y-axis;

a housing defining a first longitudinal end, a second longitudinal end, and a cavity that extends from adjacent the first longitudinal end toward the second longitudinal end;

a plurality of mechanical components including one hydraulic interacting component that are disposed in the cavity; and an inlet and an outlet that are in fluid communication with the cavity, the inlet and the outlet being disposed at the second longitudinal end;

wherein a mounting flange is disposed at the first longitudinal end of the housing, the shaft extends from the cavity past the first longitudinal end of the housing and through the mounting flange, the mounting flange comprising a rectangular shape with corners and defining four fastener receiving apertures arranged generally in respective corners of the rectangular shape, the four fastener receiving apertures having radius centers that are arranged in a rectangular pattern having two sides defined by an X dimension and two sides defined by a Y dimension equal to the X dimension, and a pilot projection that extends longitudinally away from the mounting flange or a pilot recess extending longitudinally into the mounting flange, defining a pilot projection diameter or a pilot recess diameter, and a ratio of the X dimension to the pilot projection diameter ranges from 1.07 to 1.11, or a ratio of the X dimension to the pilot recess diameter ranges from 1.07 to 1.11.

2. The hydraulic pump or motor of claim 1, wherein each of the fastener receiving apertures defines a slot width, and a ratio of the X dimension to the slot width ranges from 7.00 to 10.2.

3. The hydraulic pump or motor of claim 2, wherein the X dimension ranges from 148.0 mm to 152.0 mm, the slot width ranges from 15.0 mm to 21.0 mm, wherein the pilot projection or the pilot recess is the pilot projection, and the pilot projection diameter ranges from 138.0 mm to 142.0 mm.

4. The hydraulic pump or motor of claim 3, wherein the shaft receives or delivers more than 1700 n/m of torque.

5. The hydraulic pump or motor of claim 1, wherein the pilot projection or the pilot recess is the pilot projection, and the plurality of mechanical components including the hydraulic interacting component that are disposed in the cavity includes at least one of the following:

a vane, an impeller, a piston, a gear and a swash plate.

6. A hydraulic pump or motor comprising:

a shaft defining a longitudinal axis, a Y-axis extending upwardly and orthogonally from the longitudinal axis, and an X-axis extending orthogonally to the longitudinal axis, and the Y-axis;

a housing defining a first longitudinal end, a second longitudinal end, and a cavity that extends from adjacent the first longitudinal end toward the second longitudinal end;

a plurality of mechanical components including one hydraulic interacting component that are disposed in the cavity; and an inlet and an outlet that are disposed near the second longitudinal end and that are in communication with the cavity;

wherein a mounting flange is disposed at the first longitudinal end of the housing, the shaft extends from the cavity past the first longitudinal end of the housing and through the mounting flange, the mounting flange having a square shape with corners and defining a plurality of bolt receiving slots arranged generally in respective corners of the square shape, the plurality of bolt receiving slots having radius centers arranged in a square pattern having four sides each defined by an X dimension and at least one of the bolt receiving slots defines a slot width, and a ratio of the X-dimension to the slot width ranges from 7.00 to 10.2.

7. The hydraulic pump or motor of claim 6, the mounting flange further defines a pilot projection defining a pilot projection diameter, and a ratio of the pilot projection diameter to the slot width ranges from 7.00 to 10.2.

8. The hydraulic pump or motor of claim 7, wherein the X dimension ranges from 148.0 mm to 152.0 mm, the slot width ranges from 15.0 mm to 21.0 mm, and the pilot projection diameter ranges from 138.0 mm to 142.0 mm.

9. The hydraulic pump or motor of claim 8, wherein the shaft receives or delivers more than 1700 n/m of torque.

10. The hydraulic pump or motor of claim 6, wherein the plurality of mechanical components including the hydraulic interacting component that are disposed in the cavity at least one of the following: a vane, a gear, an impeller, a piston, and a swash plate.

11. A hydraulic pump assembly comprising:

a shaft defining a longitudinal axis, a Y-axis extending upwardly and orthogonally from the longitudinal axis, and an X-axis extending orthogonally to the longitudinal axis, and the Y-axis;

a housing defining a first longitudinal end, a second longitudinal end, and a cavity that extends from adjacent the first longitudinal end toward the second longitudinal end;

a plurality of mechanical components including at least one hydraulic interacting component that are disposed in the cavity; and an inlet and an outlet that are disposed near the second longitudinal end, and which are in communication with the cavity;

wherein a mounting flange is disposed at the first longitudinal end of the housing, the shaft extends from the cavity past the first longitudinal end of the housing and through the mounting flange, the mounting flange comprising a rectangular shape and defining a plurality of fastener receiving apertures having radius centers arranged in a rectangular pattern within a boundary of the rectangular shape and with sides parallel to one of the X or Y axis wherein a spacing of the fastener receiving apertures along the X-axis is equal to an X dimension, and a pilot projection that extends longitudinally away from the mounting flange or a pilot recess extending longitudinally into the mounting flange, defining a pilot projection diameter or a pilot recess diameter, and a ratio of the X dimension to the pilot projection diameter ranges from 1.07 to 1.11, or a ratio of the X dimension to the pilot recess diameter ranges from 1.07 to 1.11.

12. The hydraulic pump assembly of claim 11, wherein each of the fastener receiving apertures defines a slot width, and a ratio of the X dimension to the slot width ranges from 7.0 to 10.2.

13. The hydraulic pump assembly of claim 12, wherein the X dimension ranges from 148.0 mm to 152.0 mm, the slot width ranges from 15.0 mm to 21.0 mm, and the pilot projection diameter ranges from 138.0 mm to 142.0 mm.

14. The hydraulic pump assembly of claim 13, wherein the shaft transmits more than 1700 n/m of torque.

15. The hydraulic pump assembly of claim 11, wherein the plurality of mechanical components including the at least one hydraulically interacting component that are disposed in the cavity includes at least one of the following: a vane, a gear, an impeller, a piston, and a swashplate.

16. The hydraulic pump assembly of claim 15, wherein the plurality of mechanical components includes both a piston, and a swashplate.

17. The hydraulic pump assembly of claim 11, wherein, the shaft defines an exposed free end that includes teeth.

18. The hydraulic pump assembly of claim 11, further comprising at least one M14 bolt, or at least one M16 bolt, or at least one M20 bolt that each pass longitudinally through each of the fastener receiving apertures.

19. The hydraulic pump assembly of claim 16, further comprising a valve plate that is in communication with the inlet and the outlet.

20. The hydraulic pump assembly of claim 16, further comprising a shoe that that slidably and rotatably couples the piston to the swashplate.

* * * * *